United States Patent [19]

Buchwald

[11] Patent Number: 4,490,837

[45] Date of Patent: Dec. 25, 1984

[54] AM STEREO TO FM STEREO CONVERTER

[75] Inventor: Gregory J. Buchwald, Milwaukee, Wis.

[73] Assignee: Motorola, Inc., Schaumburg, Ill.

[21] Appl. No.: 412,615

[22] Filed: Aug. 30, 1982

[51] Int. Cl.[3] ..... H04H 5/00

[52] U.S. Cl. ..... 381/15; 455/142

[58] Field of Search ..... 381/15, 16, 1, 2, 3, 381/4; 455/131, 142–144, 313–315

[56] References Cited

U.S. PATENT DOCUMENTS 2,433,093 12/1947 Crosby ..... 455/131 X
3,120,580 2/1964 Parker ..... 381/4
3,806,833 4/1974 Vano .
3,983,487 9/1976 Ohno .
4,001,729 1/1977 Weinberger .
4,196,447 4/1980 Dalke .
4,371,747 2/1983 Hilbert ..... 381/15
4,408,097 10/1983 Bahnsen et al. ..... 381/15

*Primary Examiner*—R. J. Hickey
*Attorney, Agent, or Firm*—James W. Gillman; Margaret M. Parker

[57] ABSTRACT

A converter is coupled between the antenna and the RF stage of an FM stereophonic receiver to convert received AM stereo signals into FM stereo signals. A received AM stereo signal is translated to an IF signal, and decoded into two stereo signals. These signals are then encoded into a broadcast-type FM stereophonic signal which is coupled into the front end of an FM stereo receiver.

14 Claims, 2 Drawing Figures

AM STEREO TO FM STEREO CONVERTER

BACKGROUND OF THE INVENTION

This invention relates to the field of AM stereo reception and, more particularly, to a converter unit for adding AM stereo capability to an FM stereo receiver.

As a plurality of AM stereo systems are prepared for the consumer market, it is apparent that there will be some AM stereo transmissions on the air before there are a significant number of AM stereo receivers to receive and decode those transmissions. Since a sizable part of the radio audience already possesses an FM stereo receiver, it is likely that many of those people will be hesitant to discard and replace their present radios immediately. It is to be noted that a significant fraction of the cost of an FM stereo receiver is for the power amplifiers and loud speakers. It would be highly desirable to be able to provide an FM stereo receiver or an AM/FM stereo receiver with AM stereo/FM stereo capability at minimum expense and without having to replace the whole receiver. It would also be desirable to make the addition of a converting device a simple process for a relatively unskilled purchaser to perform.

SUMMARY OF THE INVENTION

It is therefore an object of the present invention to add AM stereo capability to an existing FM stereo receiver.

It is an additional object to provide such capability at minimal expense, and with minimum difficulty for a relatively unskilled person.

These objects and other which will become apparent are provided by a device which is inserted into an FM stereo or AM/FM stereo receiver at the point where the antenna is normally coupled to the front end of the receiver. A switching circuit is provided wherein, in one position, the antenna is coupled as before and, in a second position, antenna signals are coupled through an AM front end to a stereo decoder. L and R or sum (L+R) and difference (L−R) signals are then processed, along with the appropriate oscillator signals, to provide an FM stereo signal which is coupled to the FM receiver front end for detection and demodulation into L and R outputs at the stereo speakers.

DETAILED DESCRIPTION OF THE PREFERRED EMBODIMENT

Figure 1:
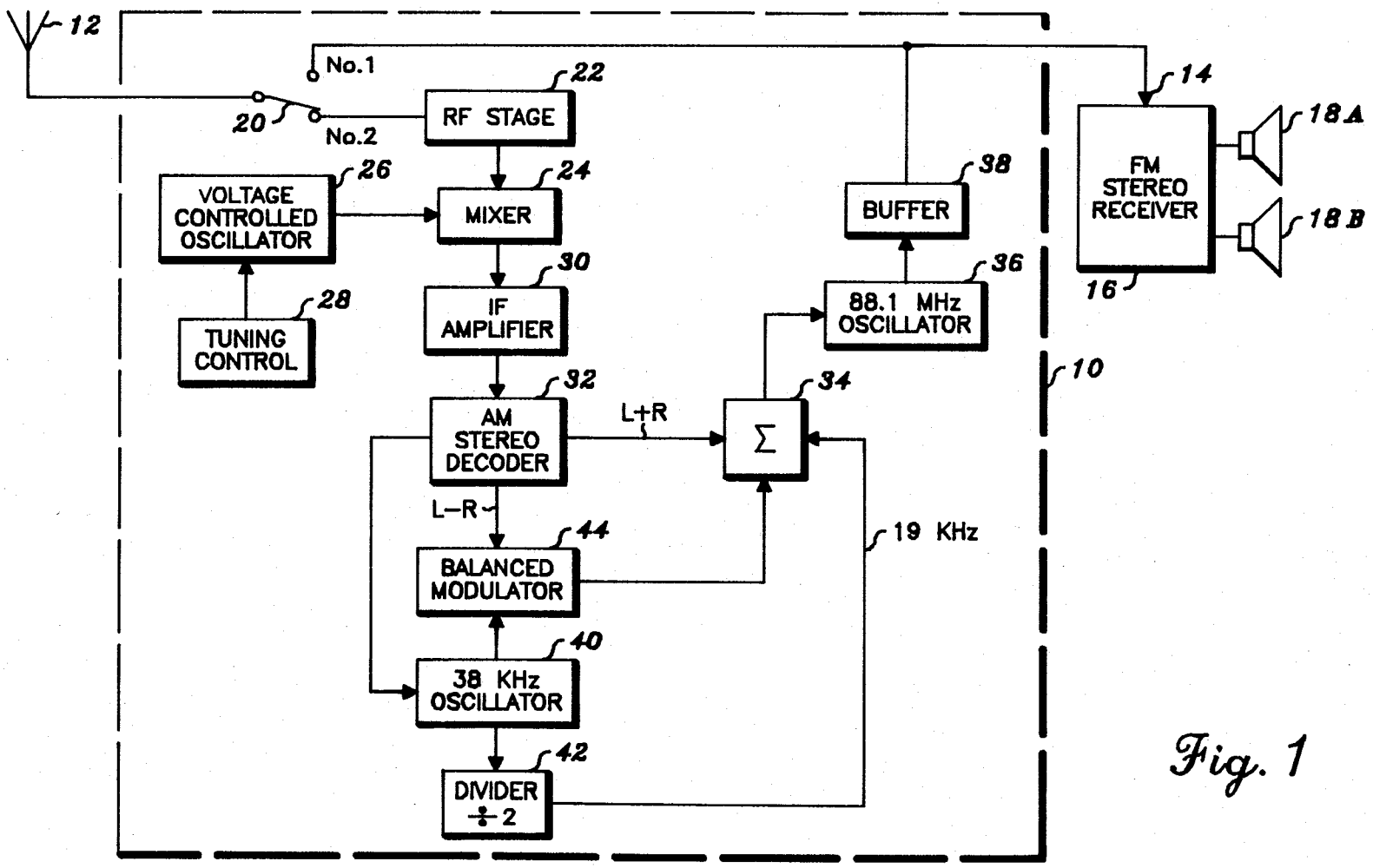
FIG. 1 is a block diagram of one embodiment of the present invention and a preferred environment.

In the block diagram of FIG. 1, a dashed line surrounds the elements of the device 10 which are added to an FM stereo receiver in accordance with the present invention. In adding the device 10, an antenna 12 is disconnected from the input 14 of an FM stereo (or AM/FM stereo) receiver 16. The receiver will include or be coupled to at least two loudspeakers 18*a*, 18*b* for producing two audible outputs, usually termed L and R for left and right.

In the device 10 the input from the antenna 12 is coupled to an SPDT switch or equivalent switching circuit 20. In a first (FM) position, the antenna 12 is coupled directly to the receiver 16 in the normal fashion. In a second (AM stereo) position, the antenna is coupled through an RF stage 22 to a mixer stage 24. A VCO 26 is controlled by a tuning control 28 and is also coupled to the mixer stage 24. The output of the mixer stage is therefore an intermediate frequency signal which is then coupled to an IF amplifier 30. The output of the IF amplifier is coupled to an AM stereo decoder 32.

The circuitry of the decoder 32 will be such as to decode one or more of the five compatible AM stereo signals proposed to the FCC in docket number 21313. Since the FCC did not make a choice but, instead, left the decision up to the "market place", it is not presently known which one of the systems will eventually prove to be commercially viable. The decoder 32 could, therefore, be similar to anyone of the five known types of decoders or a composite of two or more types as has been suggested in the art. Some possibilities are included in U.S. Pat. Nos. 4,218,586, assigned to Motorola Inc.; 4,323,731, assigned to Harris Corp.; 3,218,393, owner and inventor, Leonard R. Kahn, etc. These patents are merely representative of the many possibilities for AM stereo decoding devices which are known and which could be used within the present invention. It is to be noted that, in some decoding devices, sum and difference signals are coupled to a matrix which provides L and R outputs from the sum and difference signals. When this type of decoder is utilized in the present invention, the matrix could be omitted. Other circuits derive L and R more directly and, for use in this embodiment, would require matrixing to obtain L+R and L−R signals.

Before continuing with the description of the other elements of the drawing, it is in order to review the standards for an FM stereo broadcast signal. In the United States, the FM broadcast band comprises the radio frequency spectrum from 88 to 108 MHz, divided into 100 channels of 200 kHz each including both commercial and non-commercial broadcasting. The center of the lowest frequency channel (number 201) is therefore 88.1 MHz. Frequency modulated onto a carrier would be several distinct signals. In the main channel is the sum or monophonic signal (L+R) with a frequency range of 50 to 15,000 Hz. A pilot subcarrier at 19000 Hz serves as a control signal for use in the reception of FM stereophonic signals; e.g., for enabling a "stereo" indicator lamp. A stereophonic subcarrier, at twice the pilot subcarrier signal or 38000 Hz, is suppressed-carrier amplitude modulated with the difference signal (L−R) and, when broadcast, occupies the band of frequencies from 23 kHz to 53 kHz. The device of the present invention will provide an output signal to the "FM" terminal of the switch 20 which is substantially in accordance with the standards as given above. Some slight deviation from the exact requirements may be permissible, since the new FM signal is not broadcast.

It is to be noted that an FM broadcast signal may also contain additional information signals under a Subsidiary Communications Authorization (SCA). Such signals could include storecast, weather reports, special time signals or other special interest programming. SCA signals form no part of the present invention.

When the stereo decoder 32 receives and decodes a monaural AM signal, the monophonic signal L+R (the envelope signal) is coupled through a combining circuit 34 to be frequency modulated onto a carrier supplied by an oscillator 36. This carrier could be any unused carrier frequency within the FM broadcast band. Due to the lower limit for maximum radiated power in the non-commercial channels, it is preferable for the converter to utilize one of these channels; e.g., 88.1 MHz. The output of the combiner 34 may then be coupled through a buffer circuit 38 to the FM terminal of the switch 20, the RF input 14 of the FM stereo receiver 16. This signal would, of course, be decoded as an FM monaural signal.

It should be noted here that, if the user's receiver is-an AM/FM stereo receiver, the user may prefer to go directly to the receiver input 14 when listening to monophonic AM. In such a receiver, therefore, the switch 20 positions could be labeled "AM stereo" and "normal", for example. In the "normal" position of switch 20, the user would still have to choose "AM" or "FM" on his receiver for AM mono and FM mono/stereo listening.

If the decoder 32 detects the presence of a pilot tone or "stereo presence" signal in the decoded AM signal, an oscillator 40 is enabled by the decoder 32. The oscillator 40 may operate at 38 kHz with a divide-by-two circuit 42, or the oscillator may provide a 19 kHz signal plus its second harmonic. The 19 kHz signal is the FM pilot tone. In either event, the 38 kHz signal will be coupled to a balanced modulator 44 and suppressed-carrier amplitude modulated by the difference signal L−R from the decoder 32. The modulator output is then coupled to the combiner 34 and the 19 kHz FM pilot tone signal is likewise coupled to the combiner. The output of the combiner 34 is coupled to the oscillator 36 and is used to frequency modulate the FM carrier signal.

The new, synthesized FM stereo signal is coupled through the buffer 38 to the input 14 of the receiver 16, and is detected and processed in the receiver as if an FM stereo signal had been received at the antenna 12.

Figure 2:
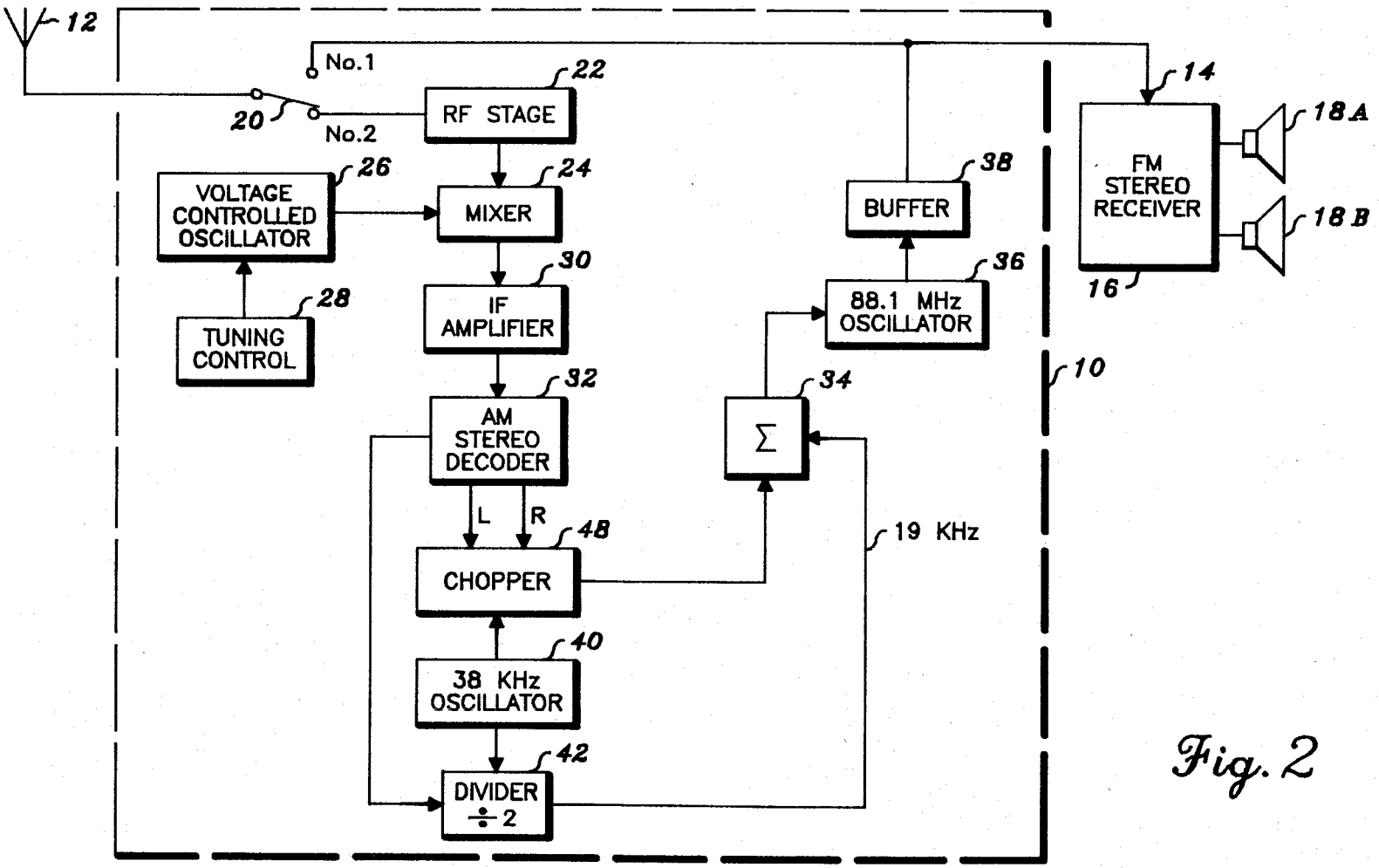
FIG. 2 is a second embodiment of the invention.

In FIG. 2, there are certain differences from the block diagram of FIG. 1 in those components having to do with the FM modulation. The outputs of the AM stereo demodulator 32' will be L and R and will be coupled to a "chopper" circuit 48. The 38 KHz oscillator 40 is also coupled to the chopper 48 and the output of the chopper is thus the composite FM stereo signal. The pilot tone or "stereo presence" signal detected by the AM stereo decoder 32 may be used to enable the coupling of the 19 kHz signal from the divider 42 to the combiner 36. Thus, an AM "stereo" signal will enable the "stereo" signal indicator lamp in the receiver 16.

Thus, there has been shown and described a circuit capable of converting received AM stereophonic signals into FM stereophonic signals. Addition of the circuit to an existing receiver requires only a simple insertion into the antenna connection of an FM stereophonic receiver. No power connection has been indicated, but it will be apparent that a power source will be required. The unit could be coupled directly to the power source for the receiver 16 or to the power supply in the receiver. The circuit allows the use of the antenna, audio amplifiers, speakers, etc., of an already-owned FM stereo receiver in adding AM stereo capability. The present invention is applicable to any compatible AM stereo system and many variations and modifications are possible within the spirit and scope of the appended claims.

What is claimed is:

1. An AM stereophonic converter for use in a receiver having at least FM stereophonic receiving capability and having an antenna and a receiver input terminal, the converter comprising:

switching means coupled to the antenna and having a first mode wherein the antenna is coupled to the receiver input terminal and having a second mode to be used at least when receiving AM stereophonic signals;

input circuitry connected to the switching means for being coupled to the antenna in the switching means second mode, the input circuitry including means for deriving from received, broadcast AM stereophonic signals, a corresponding intermediate frequency signal;

decoder means coupled to receive the IF signal and to derive therefrom a pair of stereo signals;

first oscillator means for providing two subcarrier signals;

modulator means coupled to the decoder means and the first oscillator means for modulating at least one stereo signal onto a first subcarrier signal;

combining means for combining at least the modulated subcarrier signal and a second subcarrier signal;

second oscillator means for providing a carrier signal and coupled to the combining means for frequency modulation of the carrier signal by the combined signals; and means for coupling the output of the second oscillator means to the receiver input terminal of the FM receiver.

2. An AM stereophonic converter in accordance with claim 1 and wherein the input means comprises an RF selectivity means, a tuning means, a third oscillator means, a mixer stage and an intermediate frequency amplifier stage.

3. An AM stereophonic converter in accordance with claim 1 and wherein the first subcarrier signal is a 38 kHz signal and the second subcarrier signal is a 19 kHz signal.

4. An AM stereophonic converter in accordance with claim 1 and wherein the carrier signal is a signal within the FM broadcast band.

5. An AM stereophonic converter in accordance with claim 4 and wherein the carrier signal is modulated in accordance with established FM broadcast band standards.

6. An AM stereophonic converter in accordance with claim 1, and wherein the receiver also includes second switching means for use with AM monophonic reception alternately with FM stereophonic reception.

7. An AM stereophonic converter in accordance with claim 1 and wherein the receiver is adapted to receive AM monophonic signals in addition to FM stereophonic signals.

8. An AM stereophonic converter in accordance with claim 7 and wherein the first mode of the switching means is utilized for receiving alternately AM monophonic signals and FM stereophonic signals.

9. An AM stereophonic converter in accordance with claim 1 and wherein the decoder means derives stereophonic sum and difference signals.

10. An AM stereophonic converter in accordance with claim 9 and wherein the modulator means amplitude modulates the difference signal onto the first subcarrier signal.

11. An AM stereophonic converter in accordance with claim 10 and wherein the combining means combines the sum signal with the modulated subcarrier signal and the second subcarrier signal.

12. An AM stereophonic converter in accordance with claim 1 and wherein the decoder means derives left and right stereophonic signals.

13. An AM stereophonic converter in accordance with claim 12 and wherein the modulator means provides a composite FM stereophonic output signal.

14. An AM stereophonic converter in accordance with claim 13 and wherein the combining means combines the composite FM stereophonic signal and the second subcarrier signal.

* * * * *